US007104286B2

(12) United States Patent
Servalli

(10) Patent No.: US 7,104,286 B2
(45) Date of Patent: Sep. 12, 2006

(54) WEAVING MACHINE WITH CORRECTION OF THE DISTORTION OF THE WEFT

(75) Inventor: Mario Servalli, Leffe (IT)

(73) Assignee: Sam Engineering S.A., Lugano (CH)

( * ) Notice: Subject to any disclaimer, the term of this patent is extended or adjusted under 35 U.S.C. 154(b) by 248 days.

(21) Appl. No.: 10/486,587

(22) PCT Filed: Aug. 2, 2002

(86) PCT No.: PCT/IB02/03014

§ 371 (c)(1),
(2), (4) Date: Feb. 11, 2004

(87) PCT Pub. No.: WO2004/015183

PCT Pub. Date: Feb. 19, 2004

(65) Prior Publication Data

US 2004/0221908 A1 Nov. 11, 2004

(51) Int. Cl.
*D03D 49/20* (2006.01)

(52) U.S. Cl. ..... 139/305; 139/304

(58) Field of Classification Search ..... 139/292, 139/291 R, 301, 304, 305, 311, 114, 97, 109; 28/128; 26/99
See application file for complete search history.

(56) References Cited

U.S. PATENT DOCUMENTS 5,365 A * 11/1847 Newton ..... 128/204.13
2,998,030 A * 8/1961 Koppelman et al. .... 139/387 R
3,331,402 A * 7/1967 Kathriner et al. ..... 139/291 R
3,871,419 A * 3/1975 Pfarrwaller ..... 139/114
5,649,569 A * 7/1997 De Jager et al. ..... 139/110
2004/0154146 A1* 8/2004 Pruitt, Jr. ..... 26/99

FOREIGN PATENT DOCUMENTS

CH 419 006 8/1966
FR 1 440 292 8/1966

* cited by examiner

*Primary Examiner*—John J Calvert
*Assistant Examiner*—Andrew W. Sutton
(74) *Attorney, Agent, or Firm*—Young & Thompson

(57) ABSTRACT

A weaving machine includes two temples whose axis is parallel to the weft threads and which are located at the lateral edges of the cloth, a cylindrical cloth-deflecting bar on which the cloth presses around an arc of contact before winding around a haul-off roll on which one or more backup rolls press. The clothdeflecting bar has a central cylindrical portion which connects coaxially on either side with two terminal portions next to the areas where the temples are installed, the terminal portions having a cross section which varies in shape proceeding from their ends adjacent to the central portion towards the free ends, causing a variation in the tension transmitted to the corresponding areas of the cloth by the hauloff roll, such that it varies from a minimum value at the ends of the terminal portions adjacent to the central portion to a maximum value at their free ends.

2 Claims, 5 Drawing Sheets

WEAVING MACHINE WITH CORRECTION OF THE DISTORTION OF THE WEFT

BACKGROUND OF THE INVENTION

The present invention relates to weaving machines, and more particularly refers to a weaving machine provided with a device for correcting the distortion of the weft, that is a machine able to eliminate the aberrations of perpendicularity between the weft and warp.

As those skilled in the art know, a weaving machine comprises among other things, besides various structural and supporting parts, two temples consisting of rollers whose axis is parallel to the weft threads at the lateral edges of the cloth to be produced, and a smooth or threaded cylindrical cloth-deflecting bar, on which the said cloth presses, as soon as it is gathered, around an arc of contact before winding around a haul-off roll, in contact with which are one or more back-up rolls to draw the cloth off.

The said two temples perform the function of keeping the cloth taut during and after insertion of the warp threads, and to this end exert a pressure on the cloth, pressing it against a support surface. This arrangement of the parts means that the tension exerted on the cloth by the abovementioned haul-off roll due to the back-up rolls has effects which, in the areas where the said temples are installed, are very different from those which occur in the remaining areas of the cloth, that is in the central area.

In this area the cloth, coming under the said tension of the haul-off roll, stretches longitudinally, that is at right angles to the weft, to a considerably greater extent than in the areas near the temples, where the deformation of the cloth is opposed by the action of the temples themselves. As a consequence of this, the lines of the weft threads are not perfectly straight, and comprise a central section which is basically straight and then leads into two lateral sections which inflect towards the point on which the temples press.

This means that the lateral areas of the cloth are practically unusable because of the non-perpendicularity of the weft and warp with respect to each other. Because this lack of perpendicularity affects both lateral edges of the cloth for a length of at least 10 cm, a total of some 20 cm of the cloth has to be discarded, which, with current cloth sizes, corresponds to some 15% of the width of a fabric.

The economic damage caused by this problems, which is intrinsic to the modes of operation of a weaving machine, will be obvious.

In the present state of the art the only operation carried out to correct the distortions described above is to apply differential tensions to the cloth by a manual or other type of operation, and this operation means unacceptable additional costs. More importantly, with some types of cloth it is simply impossible to perform this operation: for example in cloths on which paints, resins or the like are spread in the course of processing, it is impossible to correct the distortions that occur during the actual weaving process.

SUMMARY OF THE INVENTION

The inventor of the present innovation realized that, if differential tension could be applied to the cloth downstream of the temples, with a magnitude that varies from area to area so as to compensate for the distortions described above, it would be possible to restore exact perpendicularity between the warp and the weft. This can indeed be done by exerting less tension on the central part of the cloth, which has already been stretched to a greater extent, than that exerted on the lateral areas around the temples.

Because the magnitude of this tension depends, all other conditions being equal, on the shape and area of the arc of contact of the cloth on the cloth-deflecting bar, the inventor conceived the idea of varying this arc of contact in the different areas of the cloth by appropriate shaping of the cross section of the terminal portions of the cloth-deflecting bar, affecting the length involved in the abovementioned distortions, which may be estimated to be about 25 cm.

By this means it is possible, for a certain coefficient of friction and for a predetermined tension exerted by the haul-off roll, to "stretch" the fabric in the warp direction with a differential effect in its different areas, being greater in the lateral areas affected by the temples. Tn order to enable the same cloth-deflecting bar to be used for cloths with different properties of compactness, elasticity and coefficient of friction, the inventor also, as will be explained later, makes provision for the shaped terminal portions of the cloth-deflecting bar to be able to be rotated with respect to the cylindrical central part of the bar, so that, by exploiting the special geometrical form of the cross section of the said terminal portions, it is possible to modify the shape and/or amplitude of the said arc of contact, as well as the direction in which the fabric moves away from the said cloth-deflecting bar.

BRIEF DESCRIPTION OF THE DRAWINGS

A more detailed description will now be given of a preferred illustrative embodiment of the weaving machine according to the invention, with reference also to the accompanying drawings, which show.

DESCRIPTION OF THE PREFERRED EMBODIMENTS

Figure 1:
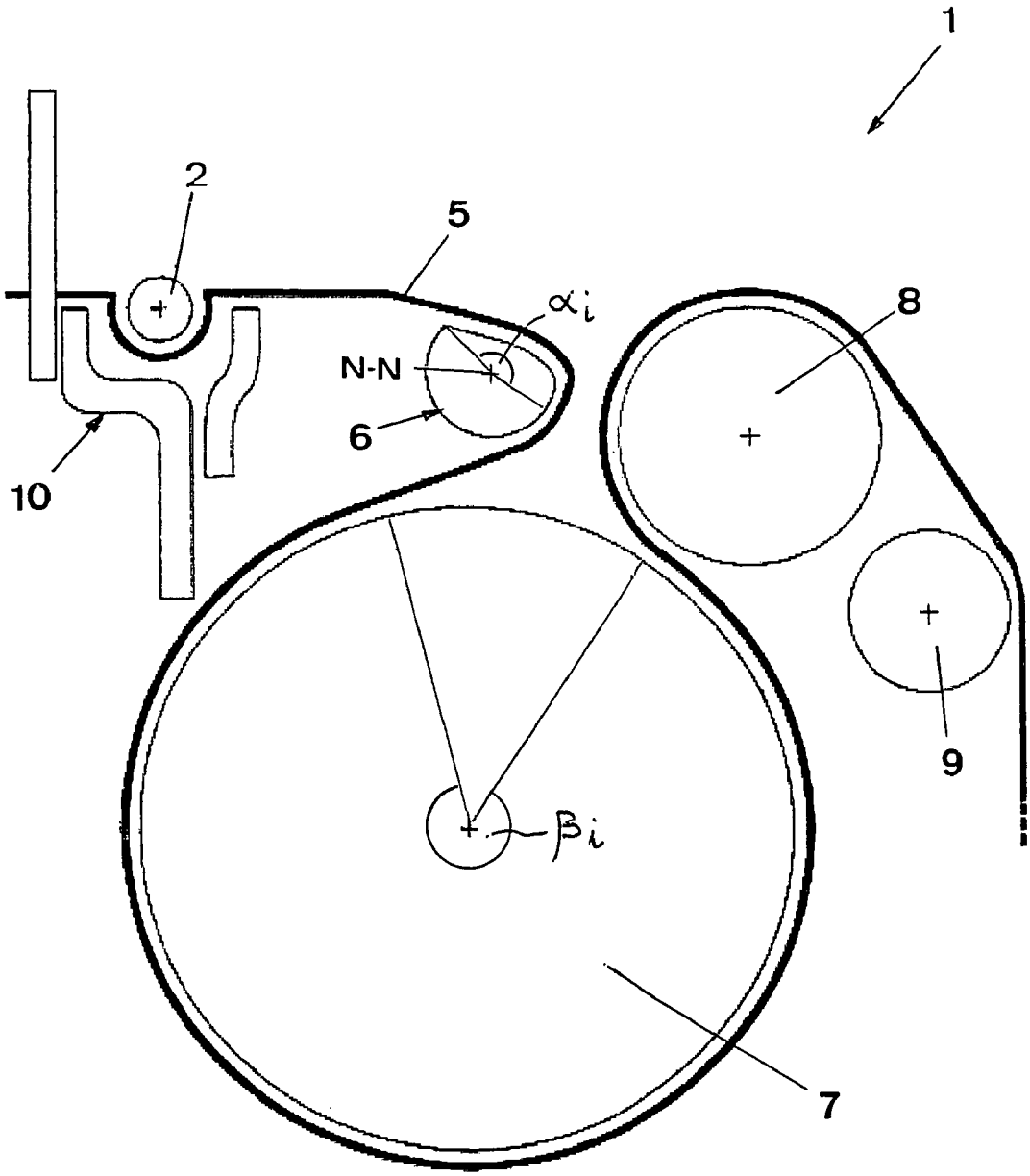
in FIG. 1, a diagrammatic side view of the weaving machine of the invention.

Taking FIG. 1 to begin with, this shows only the essential parts of a weaving machine 1 according to the invention. This machine comprises, like machines of known type, two temples 2 (in the drawing only one of these is visible) on either side of the cloth 5, which press the cloth 5 to keep it stretched during weaving, against two shaped supports 10 referred to as "cloth supports". Downstream of the abovementioned temples 2 the cloth runs around an arc of contact $\alpha_i$ on the outer surface of a cloth-deflecting bar 6, before winding, through a winding angle $\beta_i$, around a haul-off roll 7, against which one or more back-up rolls or cylinders 8, 9 press.

Figure 2:
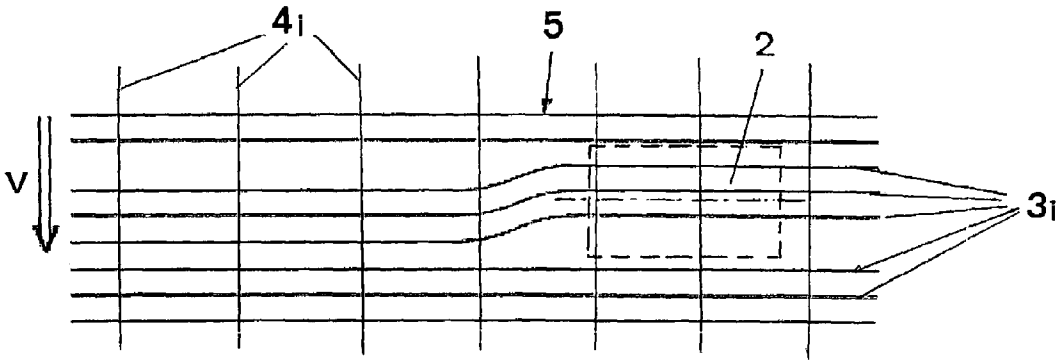
in FIG. 2, a plan view of a cloth showing the distortions of perpendicularity between the weft threads and warp threads, and how they are corrected in the machine of the invention.

With conventional cloth-deflecting bars, which are cylindrical all the way along their length, the diagram, FIG. 2, shows what happens to the weft threads 3*i* and warp threads 4*i*, as already mentioned: because of the tension applied uniformly by the haul-off roll 7 along the whole length of the cloth-deflecting bar 6, the area of the cloth 5 next to the temples 2 is held back by the pressure of the latter on the cloth supports 10, and in these areas the stretching of the cloth, which does occur in the central area of the said cloth 5, is resisted. This produces an aberration in the parallelism between the weft threads 3*i*, which in the said areas next to the temples 2 are not perpendicular to the warp threads 4*i*.

Figure 3:
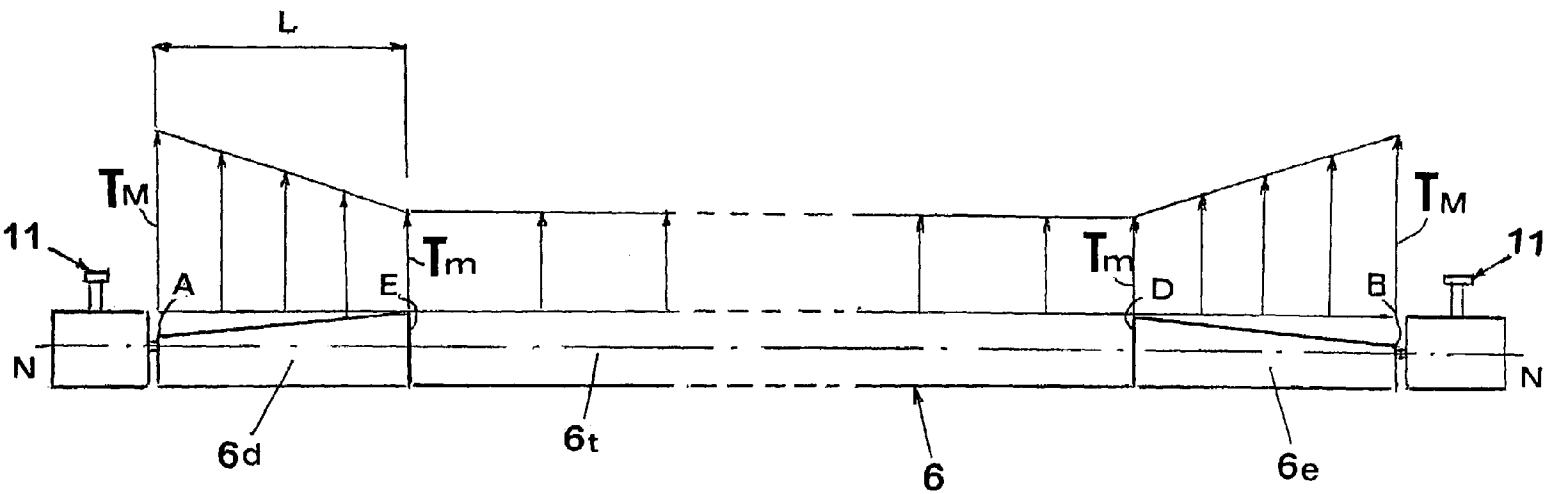
in FIG. 3, a plan view of the cloth-deflecting bar only of a weaving machine according to the invention with a diagrammatic representation of the variation of the magnitude of the tension exerted on the different areas of the cloth.

In the machine 1 of the invention, to avoid this problem and its consequences as described above, the cloth-deflecting bar 6 is composed of a central cylindrical portion 6*t* (for which see FIG. 3) which connects on either side with two terminal portions 6*d*, 6*e* of length L approximately equal to 25 cm, the cross section of which terminal portions varies throughout their length L, from a circular shape at the ends E, D adjacent to the central portion 6*t* to an asymmetrical shape, eccentric with respect to the common axis of rotation N—N, at the free ends A, B.

This particular sequence of the shapes of the cross section of the terminal portions 6*d*, 6*e* of the cloth-deflecting bar 6 has the effect of continuously changing the shape and amplitude of the arc of contact $\alpha_i$, and its position (due to how far it projects from the axis N—N) with respect to the haul-off roll 7.

Figure 4:
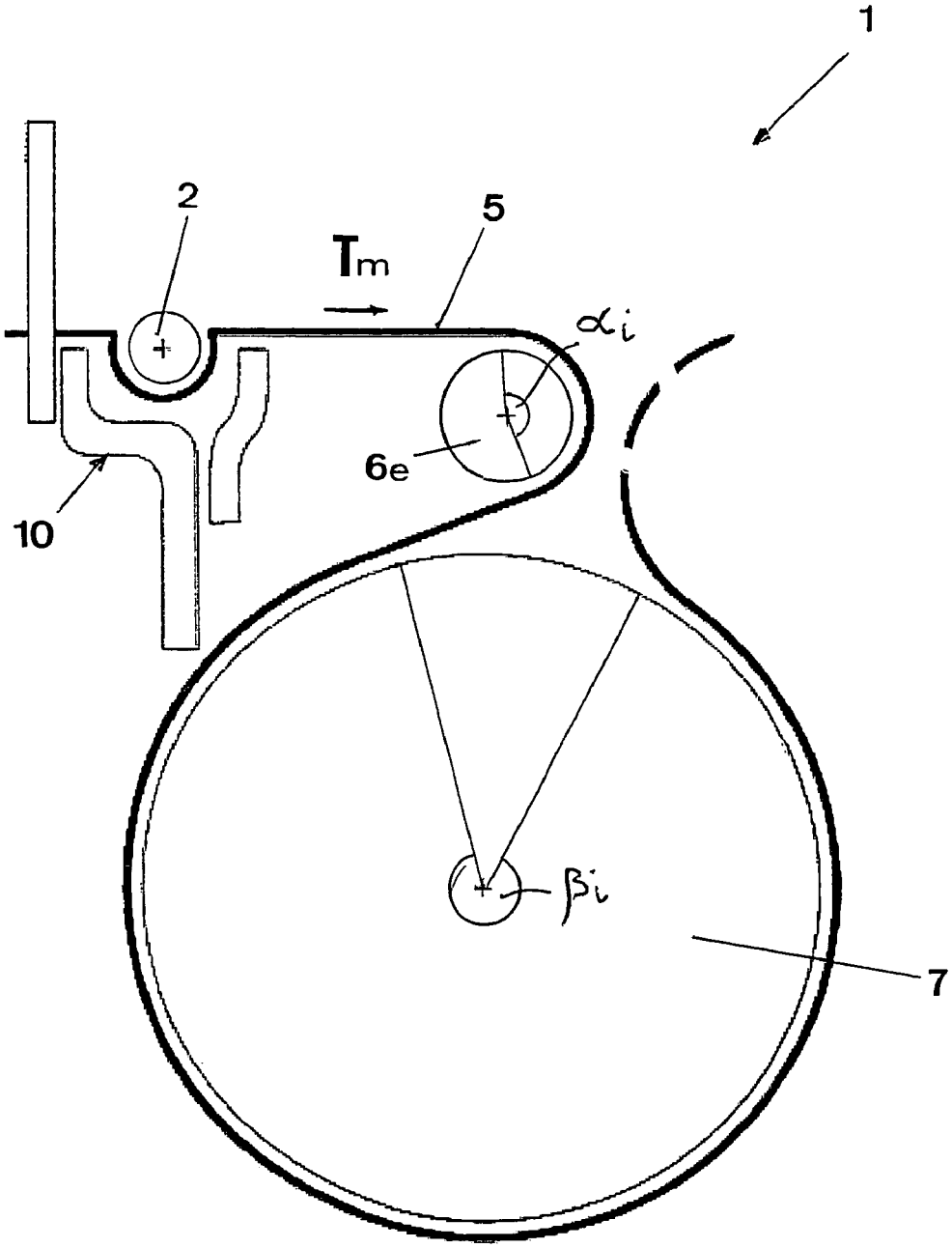
in FIGS. 4 and 5, two cross sections taken in different positions along one terminal portion of the cloth-deflecting bar, with the arrangement of the warp threads which run around these sections and wind with varying winding angles around the haul-off roll.
Figure 5:
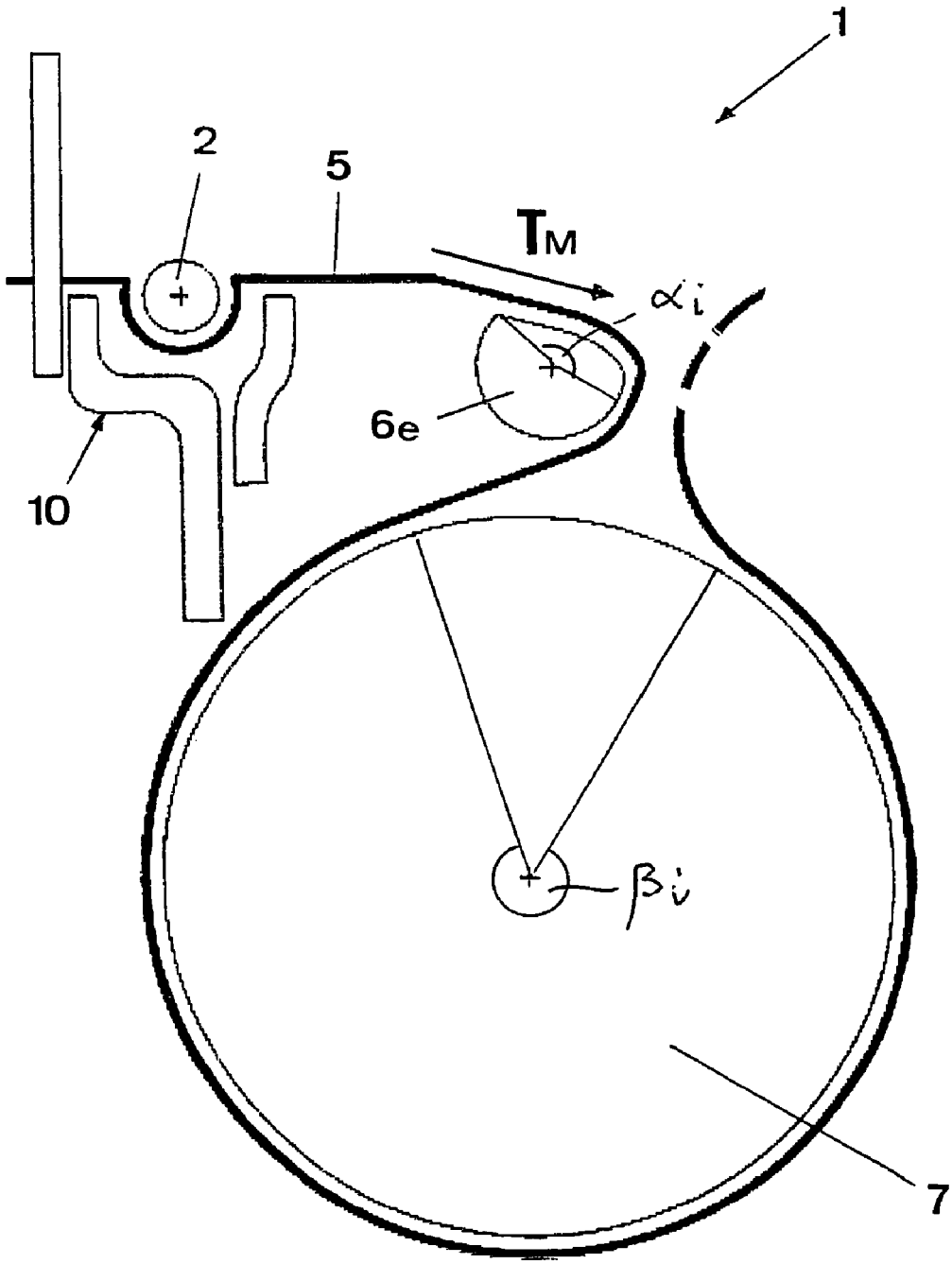

This effect is shown more clearly in FIGS. 4 and 5: whereas in the situation of FIG. 4 the tension caused on the cloth 5 by the haul-off roll 7 in the cross-sectional position depicted has a minimum value $T_m$ equal to that of the tension applied to its central portion 6*t*, in the situation shown in FIG. 5 this tension reaches, at the free ends of the terminal portions 6*d*, 6*e*, a maximum value $T_M$. The result is a gradual compensation, cross section by cross section, of the effects of the distortion generated in the course of weaving by imparting to the areas of the lateral edges of the cloth a gradual "stretching" which restores the parallelism between the weft threads 3*i* and hence their perpendicularity with respect to the warp threads 4*i* through the whole length of the cloth 5. For the distribution of tension values in the different areas of the cloth-deflecting bar 6, see FIG. 3.

Because of the fact that, depending on the type of cloth and its elasticity and coefficient of friction, different diagrams of tension in the warp thread direction may be necessary, the invention provides for forming the said two terminal portions 6*d*, 6*e* as separate parts that can be connected on opposite sides, coaxially, to the central portion 6*t*, and which can be rotated about the common axis N—N (FIG. 3) with respect to the said central portion 6*t*, and then be fixed in a desired relative position by reversible fixing means of known type, such as for example fixing screws 11 which, when tightened, press on the stationary spindle on which both the terminal portions 6*d*, 6*e* and the central portion 6*t* are mounted.

Due to the asymmetry of the shape of the different cross sections of a terminal portion constructed as described earlier, the rotation of the said terminal portion with respect to its longitudinal axis also brings about a variation in the shape, amplitude and position of the said arc of contact $\alpha_i$ at each of its cross sections, with the result that precise adjustments can be made by turning the terminal portions 6*d*, 6*e*, while the machine 1 is running, until it can be seen by eye that the distortions leading to the aberrations of perpendicularity between the weft threads 3*i* and warp threads 4*i* have been eliminated. The effect of these operations on a machine 1 according to the invention can be seen in FIG. 2: the three weft threads 3*i* drawn at the bottom have clearly been returned to the correct geometrical form which they had upstream of the temple 2 (the direction of translation of the cloth 5 is indicated by the arrow V).

Figure 7:
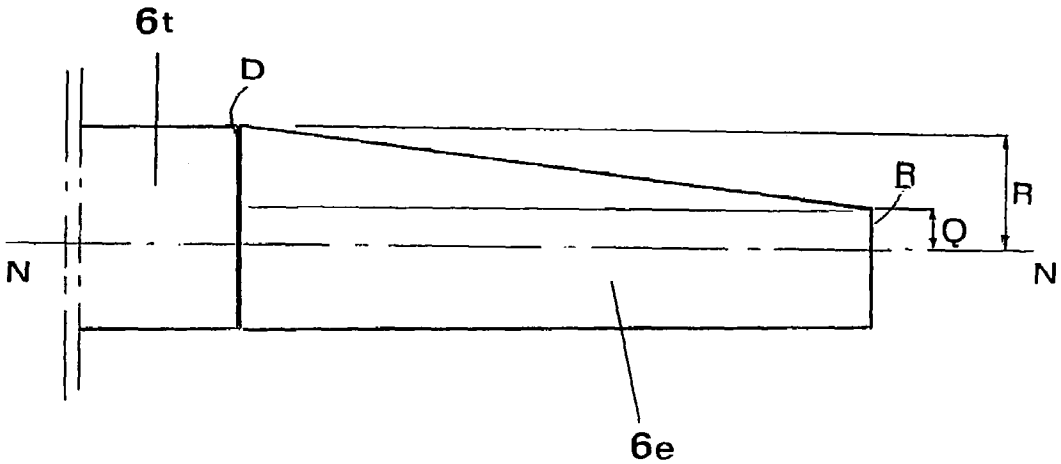
Figure 6:
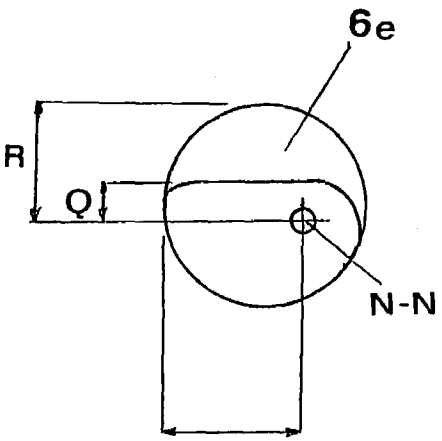
in FIG. 6, an end view of one terminal portion of the cloth-deflecting bar of the machine of the invention; and in FIG. 7, a side view of the same terminal portion as in FIG. 4.

The geometry of the differing cross sections of a terminal portion can be determined from assessments of the type of cloth and the type of processing, and a designer can therefore design the envelope of the outline of the cross sections which he considers the most appropriate. In a solution suggested by the inventor, shown in FIGS. 6 and 7 for one terminal portion 6*e* only, the latter has a cross section which is circular at the end D adjacent to the central portion 6*t*, which has an identical radius R, and joins that of the free end B via a slope generated by removal of material which reduces the distance of a part of the outline from the said radius R to a lower value Q, and increases the radius of curvature of the said outline from R to infinite when proceeding from the said end D to the free end B.

The axis of rotation (which as already explained coincides with the axis N—N of the central portion 6*t*) is also made in such a way as to pass through the centre of the said circular cross section of the end D adjacent to the central portion 6*t*, and eccentric with respect to the cross section of the other end B, so that the distance from one part of the outline of the latter to the axis of rotation N—N varies continuously from the said value R to the said lower value Q.

With a weaving machine constructed in accordance with the present invention it is possible simply and quickly to correct the distortions of the cloth described above, particularly the distortion of perpendicularity between the weft and warp, thus achieving the inventor's initial objects.

The invention of claimed is:

1. Weaving machine (1) comprising:

at least two temples (2) whose axis is parallel to the weft threads (3*i*) and which are located at the lateral edges of the cloth (5), a generally cylindrical cloth-deflecting bar (6) on which the cloth (5) presses around an arc of contact ($\alpha_i$) before winding around a hauloff roll (7) on which one or more back-up rolls (8,9) press, said cloth-deflecting bar (6) being composed of a central cylindrical portion (6*t*) which connects coaxially on either side with two terminal portions (6*d*, 6*e*) next to the areas where said temples (2) are installed, the two terminal portions (6*d*, 6*e*) having throughout their length (L) a cross section which varies in shape proceeding from their ends (E, D) adjacent to said central portion (6*t*) towards their free ends (A, B) in such a way that the position, shape and/or amplitude of said arc of contact ($\alpha_i$), when proceeding in the same direction, vary, causing a variation in the tension transmitted to the corresponding areas of the cloth (5) by the haul-off roll (7), such that it varies from a minimum value ($T_m$) at said ends of the terminal portions (C, D) adjacent to the central portion (6*t*) to a maximum value ($T_M$) at their free ends (A, B), wherein said two terminal portions (6*d*, 6*e*) of the cloth-deflecting bar (6) are separated by the central cylindrical portion (6*t*) and are connected to it coaxially in such a way that said two terminal portions (6*d*, 6*e*) rotate about the common axis (N—N) relative to the central cylindrical portion (6*t*), and wherein fixing means (11) are fitted to reversibly clamp the terminal portions (6*d*, 6*e*) when they have rotated through a desired angle with respect to said central cylindrical portion (6*t*).

2. Weaving machine (1) comprising:

at least two temples (2) whose axis is parallel to the weft threads (3*i*) and which are located at the lateral edges of the cloth (5), a generally cylindrical cloth-deflecting bar (6) on which the cloth (5) presses around an arc of contact ($\alpha_i$) before winding around a haul-off roll (7) on which one or more backup rolls (8,9) press, said cloth-deflecting bar (6) being composed of a central cylindrical portion (6*t*) which connects coaxially on either side with two terminal portions (6*d*, 6*e*) next to the areas where said temples (2) are installed, the two terminal portions (6*d*, 6*e*) having throughout their length (L) a cross section which varies in shape proceeding from their ends (E, D) adjacent to said central portion (6*t*) towards their free ends (A, B) in such a way that the position, shape and/or amplitude of said arc of contact ($\alpha_i$), when proceeding in the same direction, vary, causing a variation in the tension transmitted to the corresponding areas of the cloth (5) by the haul-off roll (7), such that it varies from a minimum value ($T_m$) at said ends of the terminal portions (C, D) adjacent to the central portion (6*t*) to a maximum value ($T_M$) at their free ends (A, B), wherein said two terminal portions (6*d*, 6*e*) of the cloth-deflecting bar (6) are separated by the central cylindrical portion (6*t*) and are connected to it coaxially in such a way that they rotate about the common axis (N—N), wherein fixing means (11) are fitted to reversibly clamp the terminal portions (6*d*, 6*e*) when they have rotated through a desired angle with respect to said central cylindrical portion (6*t*), and wherein each of said two terminal portions (6*d*, 6*e*) of the cloth-deflecting bar (6) has a cross section which is circular at the end (E, D) adjacent to the central cylindrical portion (6*t*), has an identical radius (R), and joins that of the free end (A, B) via a slope generated by removal of material which reduces the distance of a part of the outline from said radius (R) to a lower value (Q), while increasing the radius of curvature of said outline from (R) to infinite, the axis of rotation (N—N) being such as to be central with respect to said circular cross section of the end (D, E) adjacent to the central portion (6*t*), and eccentric with respect to the cross section of the other end (A, B), so that the distance from one part of the outline of the latter to the axis of rotation (N—N) varies continuously from said value (R) to said lower value (Q).

* * * * *